US008763757B2

(12) United States Patent
Zwirn

(10) Patent No.: US 8,763,757 B2
(45) Date of Patent: Jul. 1, 2014

(54) LADDER CLIMBING APPARATUS

(75) Inventor: Dustin Cory Zwirn, Greeley, CO (US)

(73) Assignee: General Electric Company, Schenectady, NY (US)

( * ) Notice: Subject to any disclaimer, the term of this patent is extended or adjusted under 35 U.S.C. 154(b) by 27 days.

(21) Appl. No.: 13/599,021

(22) Filed: Aug. 30, 2012

(65) Prior Publication Data

US 2014/0060970 A1 Mar. 6, 2014

(51) Int. Cl.
*E06C 7/16* (2006.01)
*E06C 7/12* (2006.01)

(52) U.S. Cl.
USPC ..... 182/103; 182/42; 182/148

(58) Field of Classification Search
USPC ..... 182/42–44, 103, 148
See application file for complete search history.

(56) References Cited

U.S. PATENT DOCUMENTS

| | | | | |
|---|---|---|---|---|
| 1,802,928 | A * | 4/1931 | Rowe | 198/476.1 |
| 2,490,189 | A * | 12/1949 | Alexander | 280/655 |
| 2,754,426 | A * | 7/1956 | Schiring et al. | 378/177 |
| 4,531,611 | A * | 7/1985 | Curiel | 182/44 |
| 4,637,494 | A | 1/1987 | Iida et al. | |
| 6,556,020 | B1 * | 4/2003 | McCabe et al. | 324/426 |
| 7,004,288 | B2 * | 2/2006 | Araki et al. | 182/103 |
| 7,063,159 | B2 * | 6/2006 | Patton et al. | 166/355 |
| 7,784,546 | B2 * | 8/2010 | Patton | 166/355 |
| 7,798,288 | B2 | 9/2010 | Blasek | |
| 7,987,945 | B2 | 8/2011 | Petersen | |
| 2009/0249712 | A1 | 10/2009 | Brickell et al. | |

FOREIGN PATENT DOCUMENTS

| | | | |
|---|---|---|---|
| JP | 6175075 | A | 4/1986 |
| JP | 200354880 | A | 2/2003 |

* cited by examiner

*Primary Examiner* — Alvin Chin-Shue
(74) *Attorney, Agent, or Firm* — James W. Pemrick; Ernest G. Cusick; Frank A. Landgraff

(57) ABSTRACT

A ladder climbing apparatus is provided for use with a ladder having a plurality of rungs. The ladder climbing apparatus includes a frame, a prime mover mounted to the frame and a power supply electrically connected to the prime mover. A pulley system is mounted to the frame, and is mechanically connected to the prime mover. At least two drive belts are configured so that each of the drive belts pass around the pulley system, and the drive belts are connected to the prime mover by the pulley system. A plurality of gripper elements are attached to each of the drive belts. The ladder climbing apparatus is configured so that a portion of the plurality of gripper elements are in contact with at least four rungs of the ladder during an ascent or descent, so that weight is distributed over the at least four rungs of the ladder.

14 Claims, 3 Drawing Sheets

LADDER CLIMBING APPARATUS

BACKGROUND OF THE INVENTION

The apparatus described herein relates generally to a ladder climbing apparatus. More specifically, the apparatus relates to a ladder climbing apparatus configured to carry a person up or down a ladder.

It is well known that ladders have been commonly used to enable a person to climb up or down along a wall or steep surface. Recently, attention has been focused on wind power generation as a clean energy source. A wind turbine for use in wind power generation includes a tower and a nacelle supported by the tower. A ladder is provided inside the tower and extends vertically from the base of the tower up into the nacelle. The ladder is used to gain access to the nacelle or upper portions of the tower.

The towers of utility scale wind turbines can be very high, and may range from 80 to 120 meters or more. These heights make it difficult for a person to climb the tower, and even more difficult to climb multiple towers in one day. Current occupational health and safety standards limit the number of climbs per day by maintenance personnel.

Climb assist devices have been used to assist in the ascent of a ladder. A climb assist device typically includes an endless rope which is fastened to a technician's harness with a clamp of the same type used in mountain climbing. When the technician gives a gentle tug on the rope, a motor starts and pulls on the rope, thus facilitating climbing for the technician. The rope runs along the ladder and the pull weight is set by the technician. For example, if the technician weighs 200 lbs. and sets the pull to 50 lbs., then the technician only has to raise 150 lbs. of their own body weight.

However, the technician is still required to raise a substantial portion of weight and multiple tower climbs in one day still present occupational health and safety concerns.

BRIEF DESCRIPTION OF THE INVENTION

In an aspect of the present invention, a ladder climbing apparatus is provided for use with a ladder having a plurality of rungs. The ladder climbing apparatus includes a frame, a prime mover mounted to the frame, and a power supply electrically connected to the prime mover. A pulley system is mounted to the frame, and the pulley system is mechanically connected to the prime mover. The ladder climbing apparatus also includes at least two drive belts, and each of the drive belts pass around the pulley system. The two drive belts are connected to the prime mover by the pulley system. A plurality of gripper elements are attached to each of the drive belts. The ladder climbing apparatus is configured so that a portion of the plurality of gripper elements are in contact with at least four rungs of the ladder during an ascent or descent, so that weight is distributed over the at least four rungs of the ladder.

In another aspect of the present invention, a ladder climbing apparatus is provided for use with a ladder having a plurality of rungs. The ladder climbing apparatus includes a frame, a prime mover mounted to the frame, and a power supply electrically connected to the prime mover. A pulley system is mounted to the frame, and the pulley system is mechanically connected to the prime mover. At least two drive belts are configured so that each of the drive belts pass around at least a portion of the pulley system, and the at least two drive belts are connected to the prime mover by the pulley system. A plurality of gripper elements are attached to each of the drive belts. A regenerative braking system is connected to at least one of the prime mover, the pulley system, and the at least two drive belts. The regenerative braking system is configured to at least partially recharge the power supply during a descent of the ladder climbing apparatus.

DETAILED DESCRIPTION OF THE INVENTION

One or more specific aspects/embodiments of the present invention will be described below. In an effort to provide a concise description of these aspects/embodiments, all features of an actual implementation may not be described in the specification. It should be appreciated that in the development of any such actual implementation, as in any engineering or design project, numerous implementation-specific decisions must be made to achieve the developers' specific goals, such as compliance with machine-related, system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "one aspect" or "an embodiment" or "an aspect" of the present invention are not intended to be interpreted as excluding the existence of additional embodiments or aspects that also incorporate the recited features.

Figure 1:
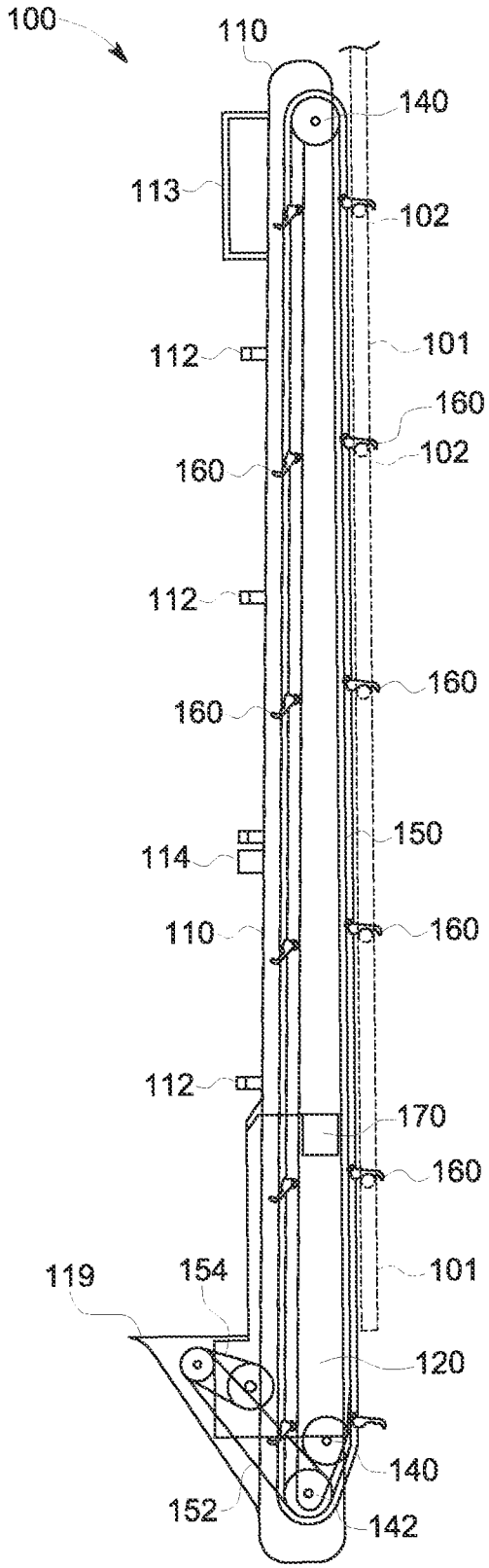
FIG. 1 illustrates a cross-sectional view of a ladder climbing apparatus, according to an aspect of the present invention.
Figure 2:
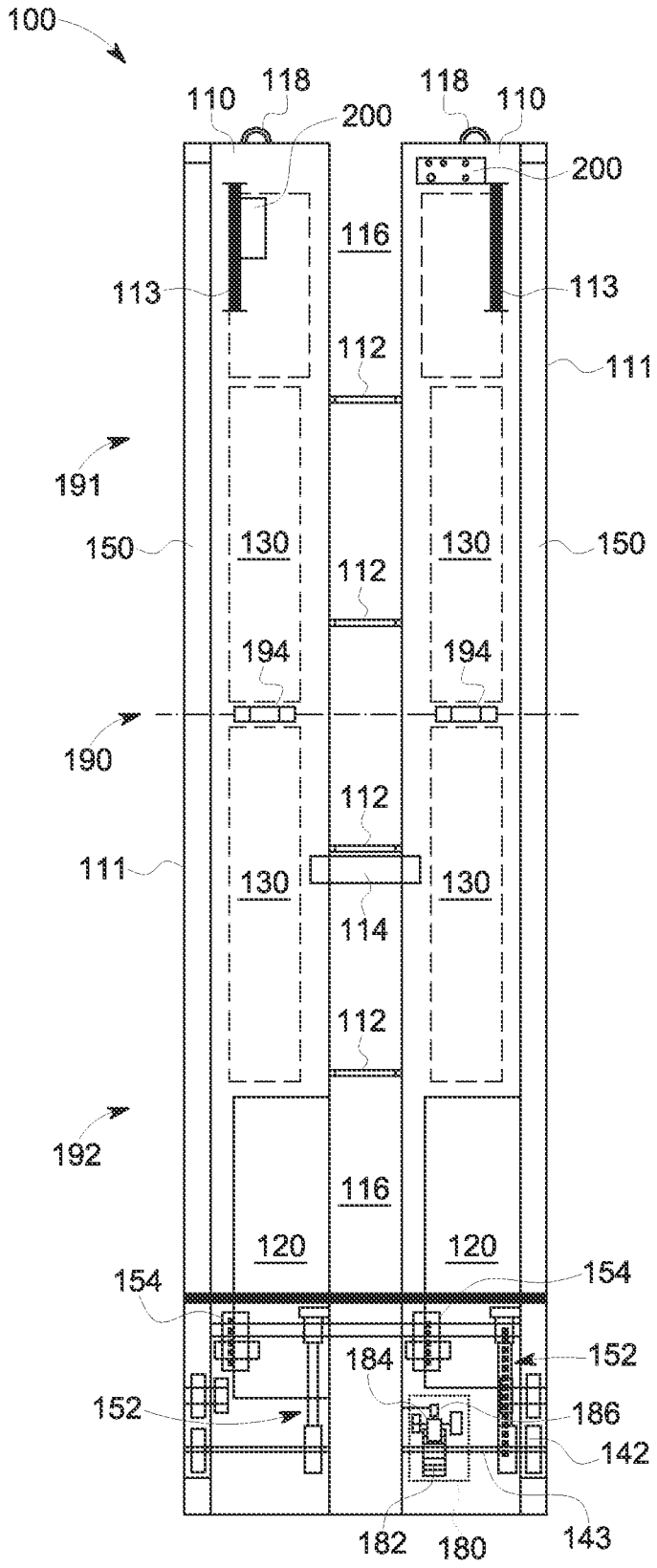
FIG. 2 illustrates a front schematic of the ladder climbing apparatus, according to an aspect of the present invention.

FIG. 1 illustrates a cross-sectional view of the ladder climbing apparatus 100 and FIG. 2 illustrates a front schematic of the ladder climbing apparatus 100, according to an aspect of the present invention. The ladder climbing apparatus 100 is configured for use with a ladder 101 (shown in phantom) having a plurality of rungs 102. The ladder rungs 102 extend horizontally between two vertically extending ladder stringers. The ladder 101 may be any typically available ladder, or the ladder 101 may be adapted for use with a wind turbine tower, or any other suitable application.

The ladder climbing apparatus 100 includes a frame 110 having two main support members 111 joined together by a plurality of bridge members 112. A wiring bridge 114 may also be provided between the two main support members 111, and the wiring bridge 114 may be used to provide a wiring conduit or path between the two main support members. However, as an alternative one or more of the bridge members 112 may also be used to provide a wiring conduit or path between the two main support members 111. The frame 110 may be comprised of a lightweight and strong material, such as aluminum or titanium, or alloys thereof. However, any suitable lightweight material may be used as desired in the specific application. The frame 110 is configured to provide a central channel 116 to provide clearance for a fall arrest system (not shown). Fall arrest systems are typically located along the center of rungs 102 and may be attached to ladder 101 or to a nearby support structure.

The frame 110 may also include means for attaching to a fall arrest system. For example, brackets 118 may be used to attach a fall arrest system onto the ladder climbing apparatus 100, or a bridge member 112 may be used for attachment purposes. The frame 110 may also be configured to have a width equal to or less than the ladder 101, as some ladders have support brackets or cages. The frame 110 also includes a step 119 for supporting a user (not shown). The step 119 may also house at least a portion of the prime mover and/or the pulley system. Frame 110 may also incorporate one or more handles 113, so that a user may hold onto the handles 113 for safety and stability purposes.

A prime mover 120 is mounted, or otherwise connected, to the frame 110. The prime mover may be comprised of a motor, and specifically a battery or electric powered motor. However, it is to be understood any suitable prime mover could be used, including but not limited to any motor or engine powered by electric power, compressed air, fuel cells or solid or liquid fuel sources.

A power supply 130 is attached to frame 110 and is electrically connected to the prime mover 120. The power supply 130 may comprise one or more batteries or one or more battery packs. The one or more battery packs may comprise sodium metal halide, sodium, sodium nickel, sodium alloy, alkaline, lithium, nickel, or lead-acid type batteries, or any suitable battery type as desired in the specific application. The batteries or battery packs may be mechanically attached to the ladder climbing apparatus. In the example shown in FIG. 2, there are four batteries or battery packs, and the frame 110 has two on each side for balance.

A pulley system 140 is mounted to the frame 110, and is mechanically connected to the prime mover 120 by belts or chains. At least two drive belts 150 are used and each drive belt 150 passes around the pulley system. The drive belts 150 are connected to the prime mover 120 by the pulley system 140 and additional fraction belts 152, 154. However, the prime mover 120 could be connected directly to the drive belts 150 via a drive gear or via a gearbox.

Figure 3:
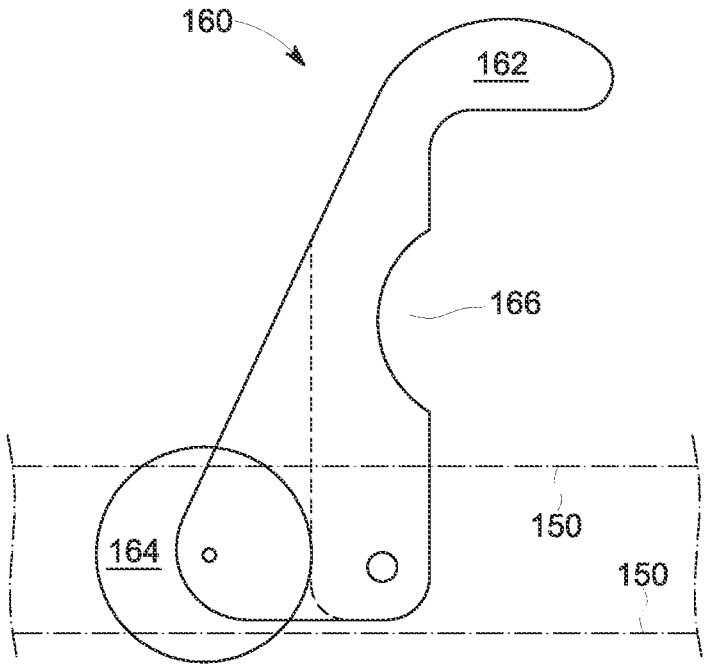
FIG. 3 illustrates a side view of a gripper element, according to an aspect of the present invention.
Figure 4:
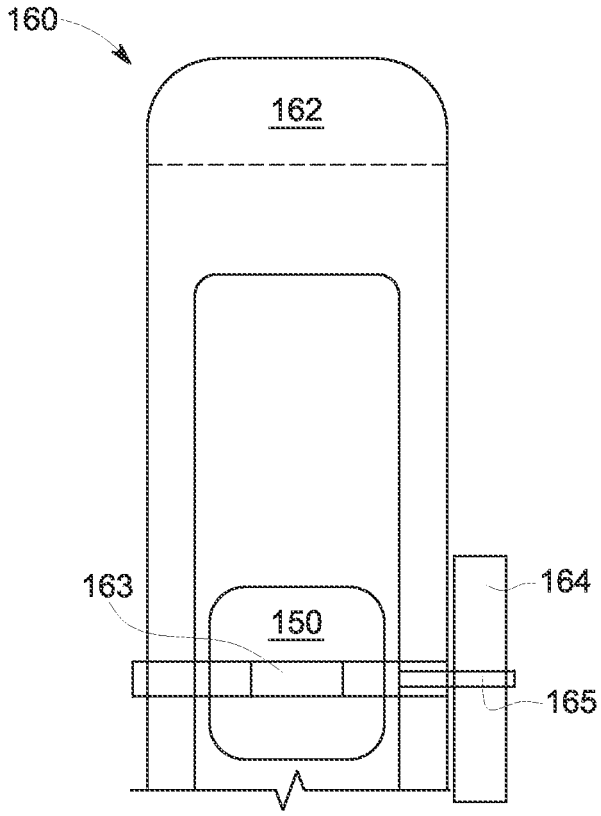
FIG. 4 illustrates a top view the gripper element, according to an aspect of the present invention.

Each drive belt 150 includes a plurality of gripper elements 160 attached thereto. A gripper element 160 is shown in more detail in FIGS. 3 and 4. FIG. 3 illustrates a side view of gripper element 160 and FIG. 4 illustrates a top view of gripper element 160. The gripper element 160 is comprised of a substantially solid finger 162 that is attached or connected to one of the drive belts 150 via a pin 165 to a spring damper system 163 embedded in the belt 150, which will absorb deviation in ladder rung spacing caused by ladder section splices. The guide bearing 164 rides in a track (not shown) and biases the finger 162 in a downward direction (or to the right in FIG. 3). As the ladder climbing apparatus navigates along a ladder (either up or down), the fingers 162 rotate and move towards the drive belt 150 when contact is lost with a ladder rung. The finger may also include a recess 166 shaped and sized to ensure stability on round ladder rungs as well as square or rectangular ladder rungs. The ladder climbing apparatus 100 is configured so that a portion of the plurality of gripper elements are in contact with at least four rungs of the ladder during an ascent or descent, so that weight is distributed over the at least four rungs of the ladder. This will help to distribute loads on the ladder rungs and to reduce, eliminate or minimize damage due to the weight of the ladder climbing apparatus and any occupant/user loads.

The ladder climbing apparatus 100 may also include a regenerative braking system 170 connected to the prime mover 120. The regenerative braking system may also be connected to the pulley system 140 and/or the drive belts 150. The regenerative braking system 170 is configured to, at least partially, recharge the one or more batteries (i.e., power supply 130) during a descent of the ladder climbing apparatus 100. The regenerative braking system 170 converts the prime mover into a generator during a descent operation.

The ladder climbing apparatus 100 may also include a ratcheting system 180 connected to at least one of the prime mover 120, the pulley system 140, or drive belts 150. In the example shown, the ratcheting system 180 is connected to drive pulley 142 via shaft 143. The ratcheting system 180 is configured to arrest the descent of the ladder climbing apparatus 100 in the event of power loss in the power supply 130. The ratcheting system 180 may be comprised of a gear 182 and a pivoting, spring loaded pawl 184 that engages the teeth on gear 182. The pawl 184 may be actuated by a solenoid 186 upon detection of a predetermined loss of power. In an additional embodiment, the ratcheting system may be configured to allow controlled descent of the ladder climbing apparatus in the event of power loss in the power supply, by incorporating of multiple pawls offset from each other or other suitable resistance incorporating gearing or braking means configured for a control rate of descent of ladder climbing apparatus 100.

According to another aspect of the present invention, the drive belts 150 may be configured to be removable and replaceable, so that drive belts having different gripper element spacing may be installed to accommodate ladders having different rung spacing. For example, a first ladder may have a vertical rung spacing of about 11 inches, while a second ladder (in a different location) may have a vertical rung spacing of about 12 inches. Removable and replaceable belts allow a user to reconfigure the ladder climbing apparatus so that it may be used with various types of ladders having different rung spacing.

The frame 110 may also be configured with a breakdown point 190 so that the ladder climbing apparatus may be folded to reduce its vertical height and facilitate transport. Frame 110 could be formed in an upper section 191 and a lower section 192. Hinges 194 are used to hingedly connect the upper section 191 to the lower section 192. Further, the hinges may be located so that top of upper section 191 folds down and rests above the top of step 119.

A control panel 200 may be located near the handles 113. The control panel contains a user interface that enables the user to control operation of the ladder climbing apparatus. For example, the control panel enables a user to control ascent rate, descent rate, and any other desired characteristic of the ladder climbing apparatus. The control panel 200 may be configured as a touch screen device, or it may use mechanical switches or levers or buttons.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A ladder climbing apparatus for use with a ladder having a plurality of rungs, the ladder climbing apparatus comprising:

a frame, the frame configured to provide a central channel, the central channel providing clearance for a fall arrest system;

a prime mover mounted to the frame;

a power supply electrically connected to the prime mover;

a pulley system mounted to the frame, the pulley system mechanically connected to the prime mover;

at least two drive belts, each of the drive belts passing around the pulley system, the at least two drive belts connected to the prime mover by the pulley system;

a plurality of gripper elements attached to each of the drive belts;

a ratcheting system connected to at least one of the prime mover, the pulley system, and the at least two drive belts, wherein the ratcheting system is configured to arrest the descent of the ladder climbing apparatus upon detection of a power loss in the power supply, and wherein the ratcheting system is configured to allow controlled descent of the ladder climbing apparatus in the event of power loss in the power supply; and wherein, the ladder climbing apparatus is configured so that a portion of the plurality of gripper elements are in contact with at least four rungs of the ladder during an ascent or descent, so that weight is distributed over the at least four rungs of the ladder.

2. The ladder climbing apparatus of claim 1, wherein the power supply is one or more batteries.

3. The ladder climbing apparatus of claim 2, wherein the one or more batteries are mechanically attached to the ladder climbing apparatus.

4. The ladder climbing apparatus of claim 3, the ladder climbing apparatus further comprising:

a regenerative braking system connected to at least one of the prime mover, the pulley system, and the at least two drive belts; and wherein the regenerative braking system is configured to at least partially recharge the one or more batteries during a descent of the ladder climbing apparatus.

5. The ladder climbing apparatus of claim 1, the ladder climbing apparatus further comprising:

a regenerative braking system connected to at least one of the prime mover, the pulley system, and the at least two drive belts; and wherein the regenerative braking system is configured to at least partially recharge the power supply during a descent of the ladder climbing apparatus.

6. The ladder climbing apparatus of claim 1, wherein each of the plurality of gripper elements is comprised of a substantially solid finger.

7. The ladder climbing apparatus of claim 1, wherein the at least two drive belts are configured to be removable and replaceable, so that drive belts having different gripper element spacing may be installed to accommodate ladders having different rung spacing.

8. The ladder climbing apparatus of claim 1, further comprising:

means for attaching to a fall arrest system.

9. The ladder climbing apparatus of claim 1, wherein the frame is configured to have a width equal to or less than the ladder.

10. The ladder climbing apparatus of claim 1, wherein the frame further comprises:

a step for supporting a user, the step housing at least a portion of at least one of the prime mover, and the pulley system.

11. The ladder climbing apparatus of claim 1, wherein the frame further comprises:

an upper section and a lower section, and wherein hinges connect the upper section to the lower section; and wherein the hinges are used for folding the ladder climbing apparatus to reduce a vertical height of the ladder climbing apparatus.

12. A ladder climbing apparatus for use with a ladder having a plurality of rungs, the ladder climbing apparatus comprising:

a frame, the frame configured to provide a central channel, the central channel providing clearance for a fall arrest system;

a prime mover mounted to the frame;

a power supply electrically connected to the prime mover, the power supply comprised of one or more batteries, the one or more batteries mechanically attached to the ladder climbing apparatus;

a pulley system mounted to the frame, the pulley system mechanically connected to the prime mover;

at least two drive belts, each of the drive belts passing around at least a portion of the pulley system, the at least two drive belts connected to the prime mover by the pulley system;

a plurality of gripper elements attached to each of the drive belts, each of the plurality of gripper elements comprised of a substantially solid finger, and each substantially solid finger is attached to one of the drive belts;

a ratcheting system connected to at least one of the prime mover, the pulley system, and the at least two drive belts, wherein the ratcheting system is configured to arrest the descent of the ladder climbing apparatus in the event of power loss in the power supply by a solenoid actuated pawl of the ratcheting system, and wherein the ratcheting system is configured to allow controlled descent of the ladder climbing apparatus in the event of power loss in the power supply;

a regenerative braking system connected to at least one of the prime mover, the pulley system, and the at least two drive belts; and wherein the regenerative braking system is configured to at least partially recharge the power supply during a descent of the ladder climbing apparatus, and wherein the ladder climbing apparatus is configured so that a portion of the plurality of gripper elements are in contact with at least four rungs of the ladder during an ascent or descent, so that weight is distributed over the at least four rungs of the ladder.

13. The ladder climbing apparatus of claim 12, wherein the at least two drive belts are configured to be removable and replaceable, so that drive belts having different gripper element spacing may be installed to accommodate ladders having different rung spacing.

14. The ladder climbing apparatus of claim 1, wherein the frame further comprises:

an upper section and a lower section, and wherein hinges connect the upper section to the lower section; and wherein the hinges are configured so the ladder climbing apparatus is foldable to reduce a vertical height of the ladder climbing apparatus.

* * * * *

UNITED STATES PATENT AND TRADEMARK OFFICE

CERTIFICATE OF CORRECTION

PATENT NO. : 8,763,757 B2
APPLICATION NO. : 13/599021
DATED : July 1, 2014
INVENTOR(S) : Zwim It is certified that error appears in the above-identified patent and that said Letters Patent is hereby corrected as shown below:

In the specification

Column 3, Line 43, delete “fraction” and insert -- traction --, therefor.

Signed and Sealed this
Seventeenth Day of November, 2015

Michelle K. Lee

Michelle K. Lee
*Director of the United States Patent and Trademark Office*